US006184615B1

(12) United States Patent
Tobari

(10) Patent No.: US 6,184,615 B1
(45) Date of Patent: Feb. 6, 2001

(54) TRAVELING WAVE DEFLECTION SYSTEM HAVING HELICAL CONDUCTORS COILED ON INSULATING CORES OF A SPECIFIABLE SPECIFIC DIELECTRIC CONSTANT

(75) Inventor: Tsutomu Tobari, Matsudo (JP)

(73) Assignee: Iwatsu Electric Co., Ltd., Tokyo (JP)

( * ) Notice: Under 35 U.S.C. 154(b), the term of this patent shall be extended for 0 days.

(21) Appl. No.: 09/162,939

(22) Filed: Sep. 29, 1998

(30) Foreign Application Priority Data

Oct. 3, 1997 (JP) ..... 9-287735

(51) Int. Cl.[7] ..... H01J 29/74

(52) U.S. Cl. ..... 313/435; 313/437; 313/421; 313/450; 315/3.6; 315/5.26

(58) Field of Search ..... 313/435, 421, 313/423, 426, 432, 437, 439, 450; 315/3, 3.6, 5.24, 5.26, 5.27

(56) References Cited

U.S. PATENT DOCUMENTS 4,093,891 * 6/1978 Christie et al. ..... 313/421

5,038,075 8/1991 Tobari et al. ..... 313/435

FOREIGN PATENT DOCUMENTS 57-10539 2/1982 (JP) .

* cited by examiner

*Primary Examiner*—Nimeshkumar D. Patel
*Assistant Examiner*—Joseph Williams
(74) *Attorney, Agent, or Firm*—Woodcock Washburn Kurtz Mackiewicz & Norris

(57) ABSTRACT

A vertical deflection system for a CRT is disclosed which has a pair of traveling wave deflectors disposed opposite each other across a path of beam from gun to target. Each deflector has a helical conductor in the for of a strip of sheet metal coiled around an elongate core of insulating material. For the provision of a CRT capable of handling a wide band of frequencies, the dispersion characteristic of each traveling wave conductor is optimized through adjustment of the specific dielectric constant of the insulating core. Preferred values of the specific dielectric constant are specified in relation to the characteristic impedance of the traveling wave conductor.

2 Claims, 6 Drawing Sheets

TRAVELING WAVE DEFLECTION SYSTEM HAVING HELICAL CONDUCTORS COILED ON INSULATING CORES OF A SPECIFIABLE SPECIFIC DIELECTRIC CONSTANT

BACKGROUND OF THE INVENTION

This invention relates to a traveling wave deflection system for use in a cathode ray tube (CRT), and more particularly to such a system having a pair of deflectors each having a helical conductor coiled around an elongate core of electrically insulating material. Still more particularly, the invention pertains to the optimization of the dispersion characteristic of the helical wave paths.

The electron beam in a CRT will be deflected in proportion with the deflection voltage if that voltage remains unchanged during the passage of the electrons through the deflection field. In case the deflection frequency is high, however, the deflection voltage may change during the passage of the electrons through the deflection system, making it difficult to deflect the beam as required.

A familiar solution to the foregoing problem is the traveling wave deflection system, for use in particular in CRTs for observation of signals from zero to several hundred megahertz in frequency. The traveling wave deflection system is such that the phase velocity of the deflection signal traveling through a pair of deflectors of helical or other configurations is made approximately the same as the speed of the electron beam. The deflection signal is thus made to act on the electron beam for a longer, sufficient period of time for its desired deflection, making possible the provision of a wide band CRT.

Japanese Pat. Pub. No. 57-10539 teaches a traveling wave deflection system in which each deflector has a grounded conductor, or a pair of such conductors, inserted between an insulating core and a helical conductor wound thereon. The grounded conductor or conductors are intended primarily to make the characteristic impedance of the traveling wave conductor constant in the traveling direction of the undeflected beam. Tobari et al. U.S. Pat. No. 5,038,075 suggests an analogous deflection system wherein the grounded conductors are so made as to compensate for an inductance drop toward the end of each traveling wave conductor and so to make the characteristic impedance thereof constant all along the beam path.

Such prior art systems have proved to possess a weakness, however, in that they are devoted solely to making constant the characteristic impedance of the traveling wave conductors, paying no attention to their dispersion characteristic (i.e. variation in speed of the traveling wave through the conductors). The provision of a wide band traveling wave deflection system requires not only the solution of the problem of the reflections of the deflection signal waveforms due to inconstancy of the characteristic impedance of the traveling wave conductors but also the improvement of their dispersion characteristic for faithful transmission of the deflection signal waveforms. Also required is the reduction of the waveform distortion resulting from the mismatching of the speed of the electron beam and the phase velocity due to the dispersion characteristic of the traveling wave paths.

The phase velocity of a wave will be constant regardless of frequency if it is traveling through a path that is not dispersive. Phase velocity in this case is expressed as $$u=\omega/\beta \tag{1}$$

where u=phase velocity,

ω=angular frequency,

β=phase constant.

The nature of the transmission path is represented by the phase constant β. The phase constant for a transmission path where inductance and capacitance per unit length are expressed as L and C is given by $$\beta=[1/(LC)^{1/2}]\omega.$$

The phase velocity of a wave is a function of angular frequency if it is traveling through a dispersive path. Analyses of traveling wave deflectors indicate that the transmission of a pulse waveform without phase distortion requires constant phase velocity regardless of frequency and a linear phase characteristic, as indicated by Equation (1). A transmission path whose nature is expressible by Equation (1) is capable of distortionless transmission of signal waveforms, with a constant phase velocity regardless of frequency.

Graphically represented in FIG. 10 of the drawings attached hereto are the results of simulation experiments, showing a waveform A in response to the transmission of an input pulse Po through a transmission path in which $$\beta=\omega/c, \text{ and}$$

$$u=c$$

where c is a constant. Also given in FIG. 10 is a waveform B in response to the transmission of the input pulse Po through a transmission path in which the phase constant is expressed as $$\beta=\omega/(c+a\omega+b\omega^2),$$

where a, b and c are all constants, and in which the phase velocity is a function of the angular velocity:

$$u=c+a\omega+b\omega^2.$$

The response waveform A in FIG. 10 demonstrates that distortionless transmission is possible if phase velocity is constant over angular frequency. On the other hand, in the case of a transmission path in which phase velocity increases with angular frequency, the response waveform B has a preshoot distortion and is slow in rise time. CRTs incorporating such traveling wave deflectors are inconveniently narrow in frequency band.

In traveling wave deflection systems of CRTs, the phase velocity of the input signal must be reduced to approximately one tenth of the speed of light in order to match the electron beam speed. This requirement has been met by use of helical conductors as guided signal paths, as in the prior art systems set forth previously. The pitch of the helices may be made one tenth of the length of each turn in order to approximate the required phase velocity.

However, despite their undisputable advantages, the helical conductors of the prior art deflection systems have proved still unsatisfactory for the provision of wide band CRTs. The neighboring turns of the helical conductors are, unavoidably, electrically coupled together. Such couplings are negligible at lower frequencies because then little or no potential differences are created between the conductor turns.

At higher frequencies, however, potential differences and therefore field couplings are created between the conductor turns, to such an extent that the capacitances between them become inconveniently high. Such capacitances have conventionally made the phase velocity increasingly higher with frequency, resulting in distortions of pulse waveforms such as that indicated at B in FIG. 10 and in limitations of the frequency band. Additionally, the phase velocity of the input signal has failed to match the electron beam speed, and band limitations have occurred by the effect of electron travel.

SUMMARY OF THE INVENTION

The present invention aims at the provision of a wide band traveling wave deflection system through optimization of the dispersion characteristic of the traveling wave paths.

The invention also seeks to attain the first recited objective without in any way making complex the construction of, or making difficult the manufacture of, the traveling wave deflection systems of prior art designs.

Briefly, the invention may be summarized as a traveling wave deflection system having a pair of deflectors disposed opposite each other across a path of an electron beam. Each deflector comprises a core of electrically insulating material extending along the electron beam path, a helical conductor coiled around the core, and a grounded conductor mounted to the core and disposed inside the helical conductor and extending along the electron beam path. The insulating core has a specific dielectric constant determined for an optimum dispersion characteristic of the deflector.

Preferably, the specific dielectric constant of the insulating core is determined in relation to the characteristic impedance of the helical conductor thereof. For example, the specific dielectric constant is from nine to fourteen when the characteristic impedance is from 80 ohms to 120 ohms, from five to ten when the characteristic impedance is more than 120 ohms and not more than 140 ohms, and from four to six when the characteristic impedance is more than 140 ohms and not more than 160 ohms.

The invention as summarized above is based upon the finding that the capacitances between the adjacent turns of each helical conductor depend upon the specific dielectric constant of the insulating core around which the conductor is coiled. Such interturn capacitances are therefore adjustable through adjustment of the specific dielectric constant of the core, with a view to an optimum dispersion characteristic and, inconsequence, a wider band of frequencies to be handled.

It will be appreciated that the invention requires no alternation of, and no addition to, preexisting parts of traveling wave deflectors of the known helical conductor type. An appropriate choice of materials for the insulating cores is all that is needed to accomplish the remarkable effects.

The above and other features and advantages of this invention and the manner of realizing them will become more apparent, and the invention itself will best be understood, from a study of the following description and appended claims, with reference had to the attached drawings showing some preferred embodiments of the invention.

DESCRIPTION OF THE PREFERRED EMBODIMENTS

Figure 5:
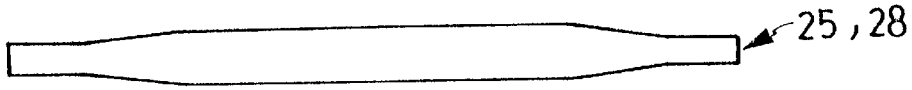
FIG. 5 is a plan view of the grounded conductor of one of the deflectors of the FIG. 1 deflection system.
Figure 6:
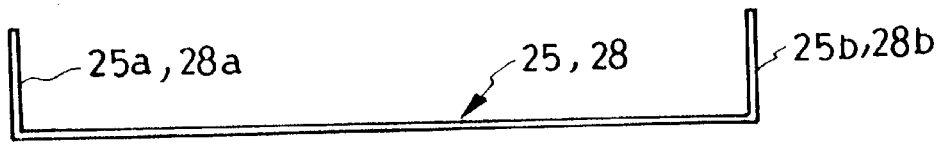
FIG. 6 is a side elevation of the FIG. 5 grounded conductor.
Figure 8:
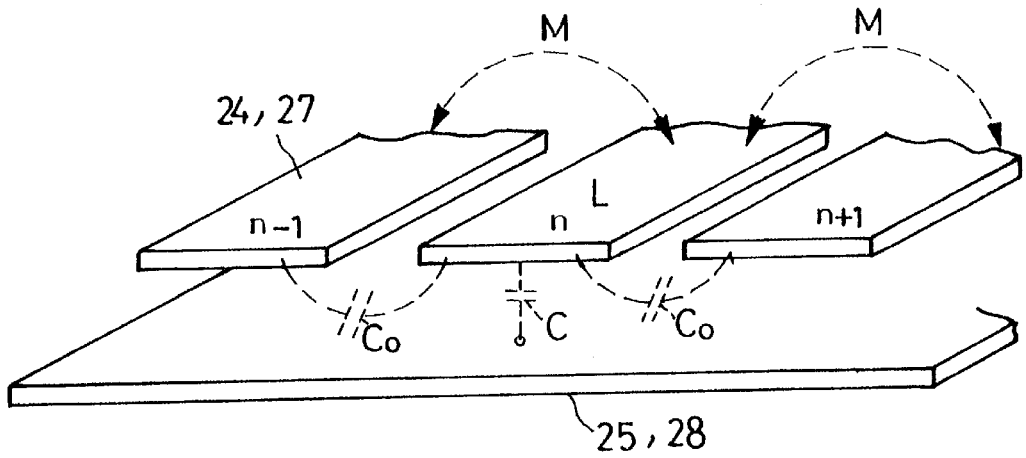
FIG. 8 is an approximate representation of one of the helical wave paths of the FIG. 1 deflection system which is explanatory of the principles of the present invention.
Figure 7:
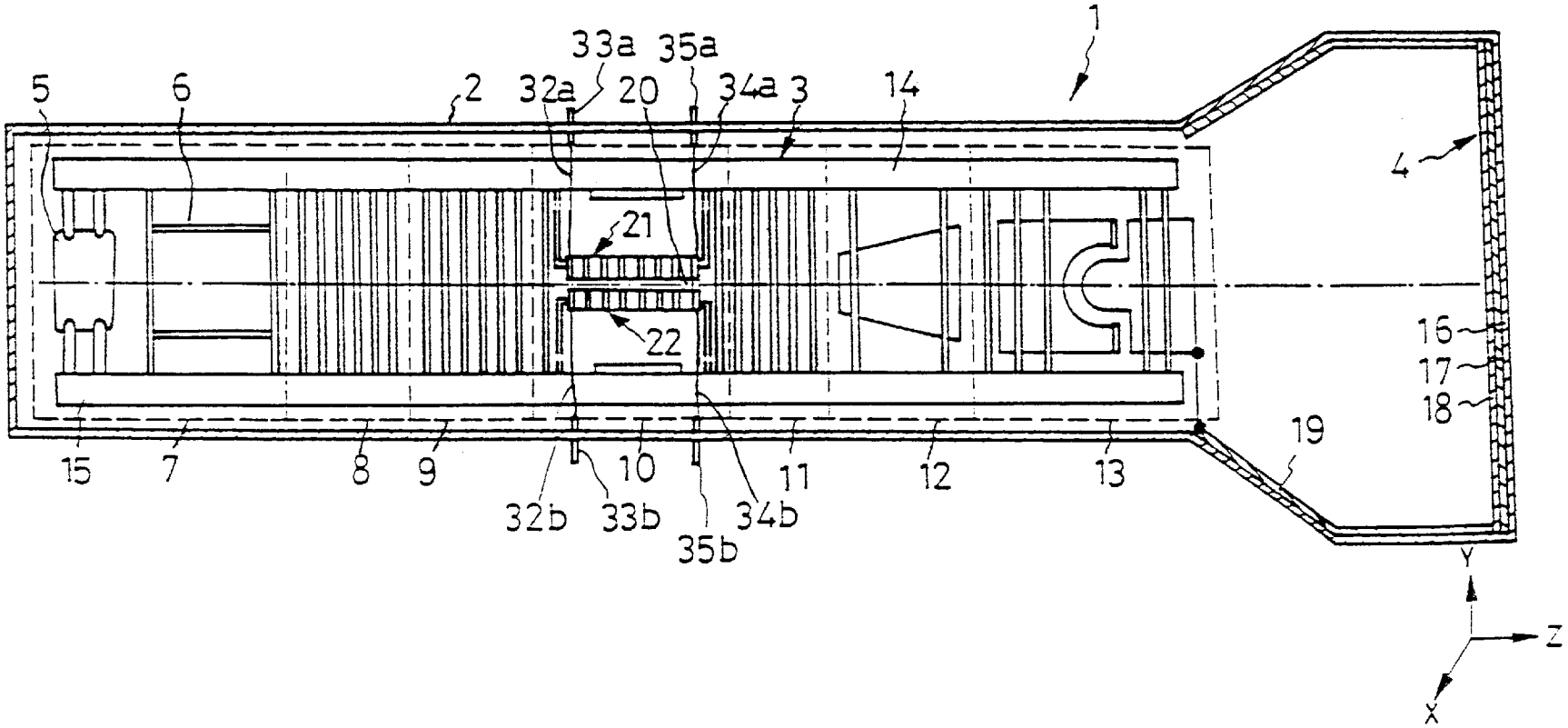
FIG. 7 is a diagrammatic longitudinal section through a CRT incorporating the FIG. 1 deflection system for vertical deflection of the electron beam.
Figure 10:
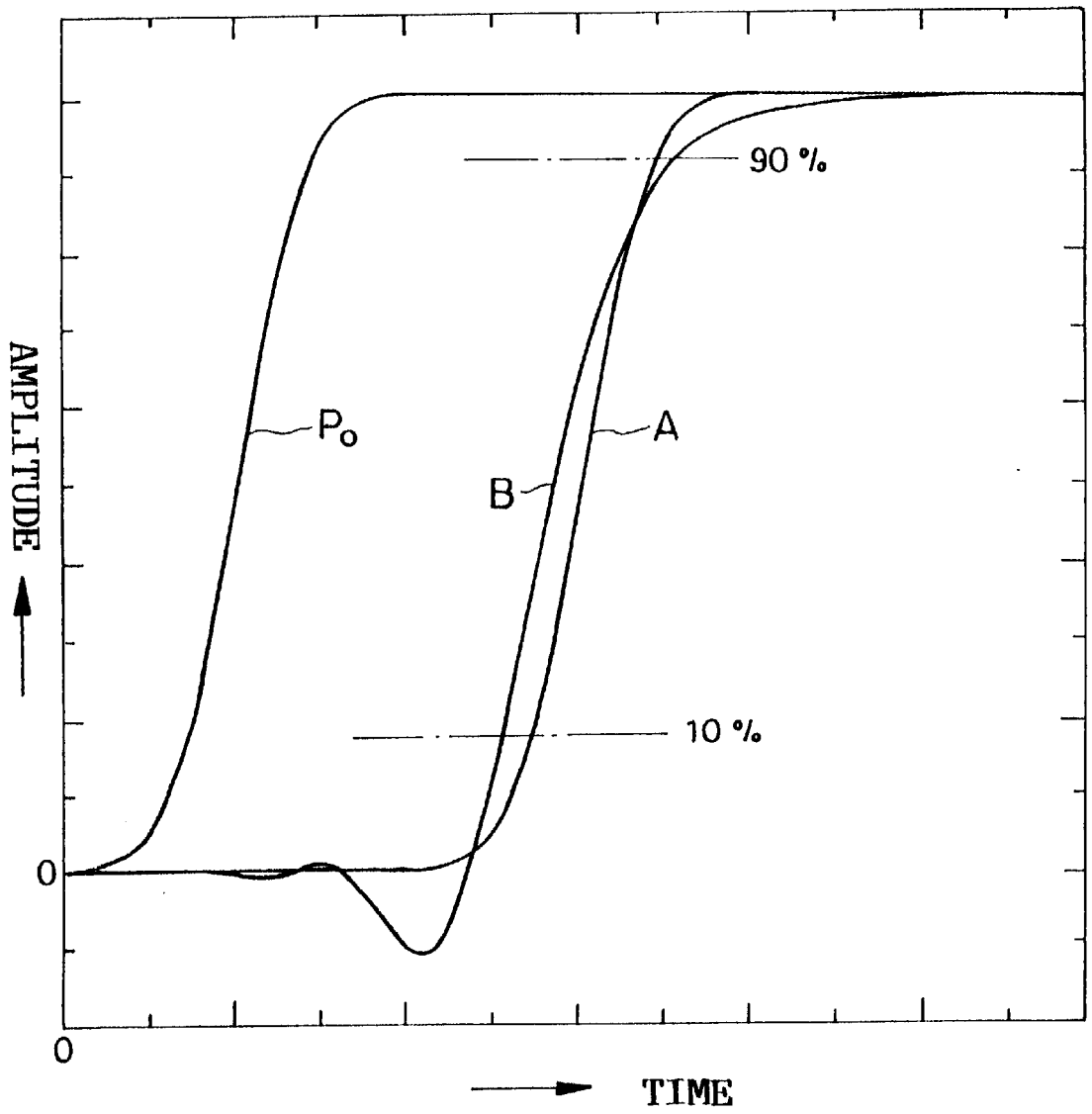
FIG. 10 is a graph plotting the waveforms in response to same input waveform when the wave is guided through a path in which phase velocity is constant over angular frequency, and a path in which phase velocity increases with angular frequency.

The traveling wave deflection system will now be described in detail as incorporated in a CRT for vertical deflection of the beam. FIGS. 1–6, 8 and 9 illustrates the exemplified vertical deflection system according to the invention, which lends itself to use in a CRT that may typically be constructed as shown in FIG. 7. With reference first to FIG. 7 the typified CRT 1 has an evacuated envelope 2 of generally tubular shape in which there is housed a gun-and-electrode assembly 3 for generating a beam of electrons and bidirectionally deflecting the beam on its way toward a target or fluorescent screen 4 at the enlarged front end of the envelope which is herein shown directed to the right.

The gun and electrode assembly 3 includes an electron gun 7 comprised of a cathode-and-control-grid subassembly 5 and an anode 6. The electron gun 7 emits electrons in a beam directed toward the fluorescent screen 4. The alternating dot and dash line 20 represents the straight-line path of the electron beam when it is not deflected. Extending axially of the envelope 2, the undeflected beam path 20 may be thought of as being parallel to the Z-axis indicated in FIG. 7.

Additionally, the gun and electrode assembly 3 comprises a first 8 and a second 9 quadrupolar lens, a traveling wave vertical deflection system constituting the gist of this invention, a third quadrupolar lens 11, a horizontal deflection system 12, and a scan expansion lens 13, which are all arranged in that order along the undeflected beam path 20 from gun 7 to screen 4. All the listed components 7–13 of the gun and electrode assembly 3 are supported by and between a pair of common support beams 14 and 15 extending longitudinally of the envelope 2. The vertical deflection system 10 and horizontal deflection system 12 deflect the electron beam in two orthogonal directions, that is, along the Y- and X-axes, also indicated in FIG. 7, which are perpendicular to each other and to the Z-axis.

The fluorescent screen 4 is shown as a lamination of a faceplate 16, a phosphor layer 17, and a conductor layer 18. The conductor layer 18 is joined directly to a postaccelerating electrode 19 lining the enlarged end portion of the envelope 2.

All but the vertical deflection system 10 of the listed components of the CRT 1 are conventional in construction, arrangement and operation. No further detailed description of such known parts of the CRT is therefore considered necessary.

Figure 1:
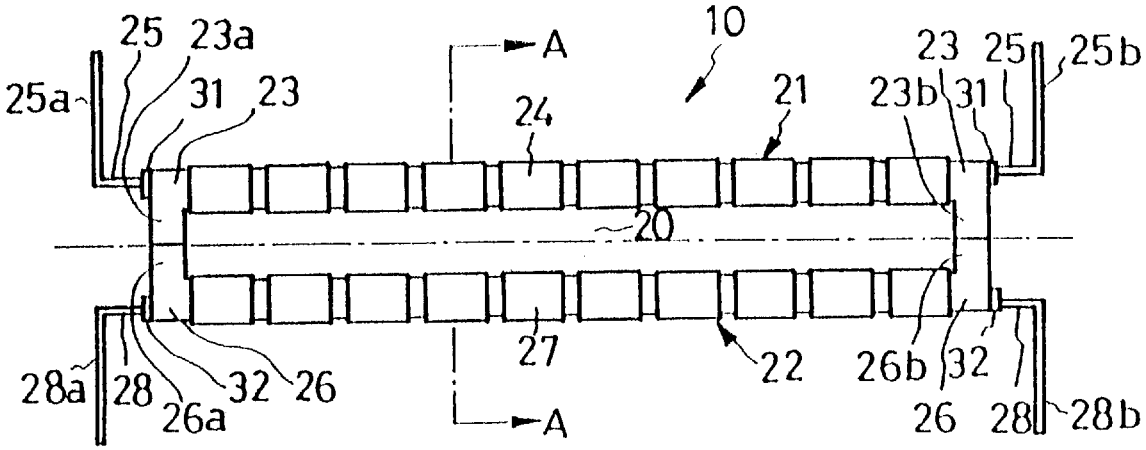
FIG. 1 is a side elevation of the traveling wave deflection system to which the present finds application.
Figure 2:
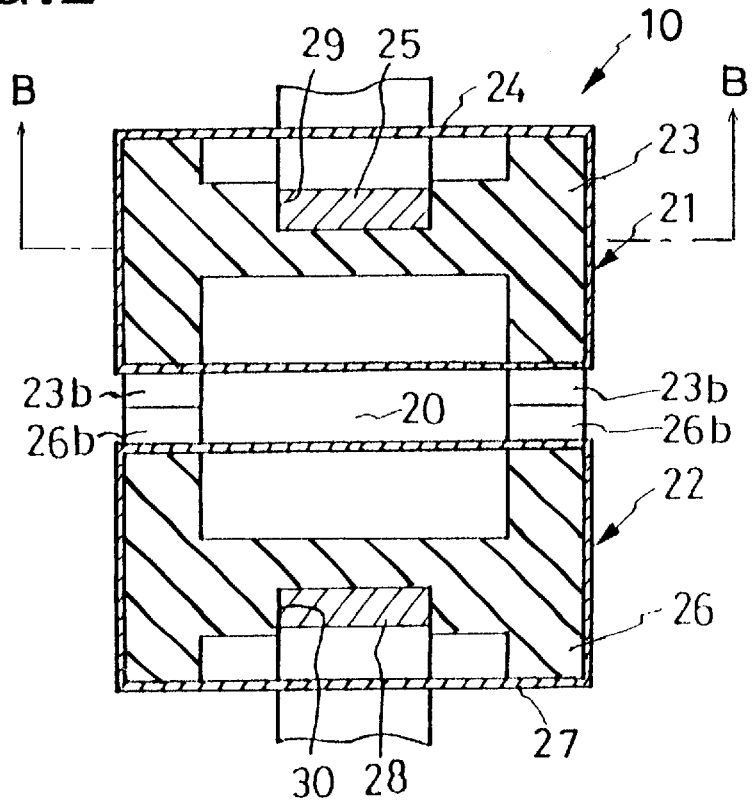
FIG. 2 is an enlarged cross section through the deflection system, taken along the line A—A in FIG. 1.

As illustrated on an enlarged scale in FIGS. 1 and on a more enlarged scale in FIGS. 2, the vertical deflection system 10 comprises a pair of opposed deflectors 21 and 22 which are disposed opposite each other across the path 20 of the undeflected electron beam. As will be noted also from FIG. 3, the deflectors 21 and 22 are of like construction, each comprising an elongate core 23 or 26 of electrically insulating material extending along the beam path 20, a helical conductor 24 or 27 wound around the core, and a grounded conductor 25 or 28 embedded in the core.

Figure 3:
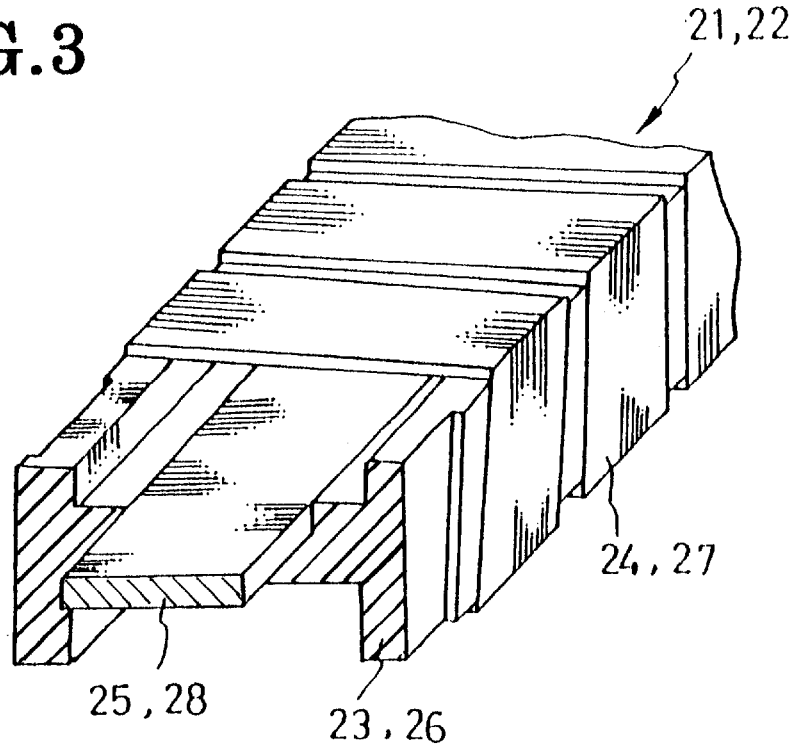
FIG. 3 is a perspective view, partly broken away and partly sectioned for illustrative convenience, of one of the pair of deflectors of the FIG. 1 deflection system.
Figure 4:
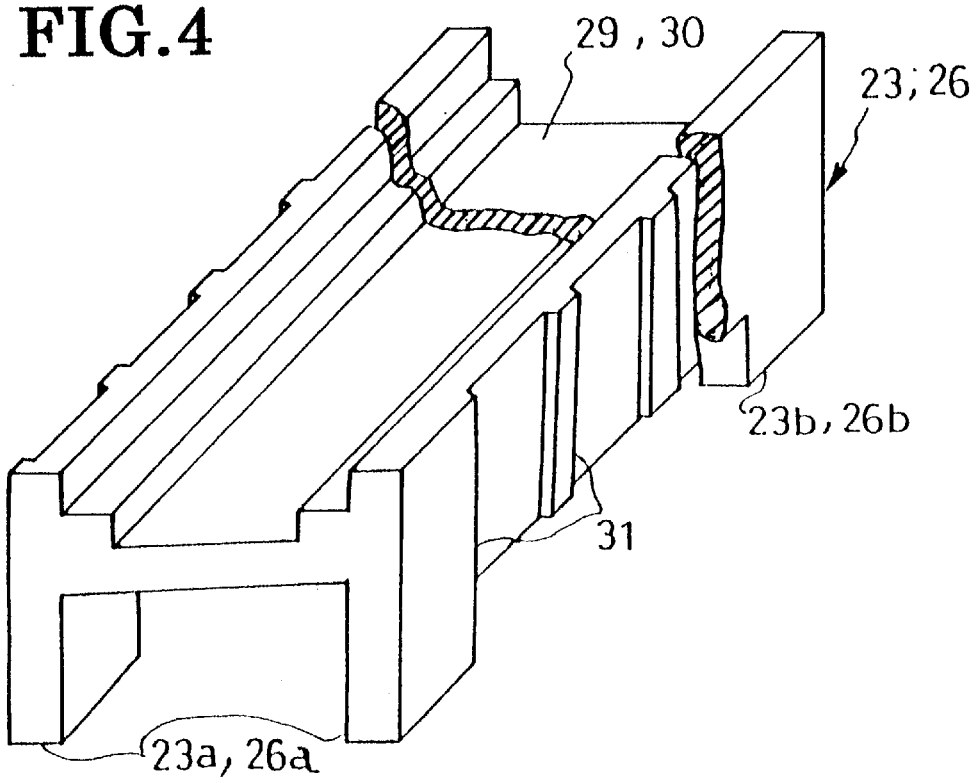
FIG. 4 is a perspective view, partly broken away for illustrative convenience, of the insulating core of one of the deflectors of the FIG. 1 deflection system.

With reference to FIGS. 1–4, particularly to FIG. 4 which reveals one core 23 or 26 stripped of the helical conductor 24 or 27 and grounded conductor 25 or 28, each core is formed to include a pair of legs 23*a* or 26*a* on its beam entrance end and another pair of legs 23*b* and 26*b* on its beam exit end. The four pairs of legs on the two cores 23 and 26 are disposed in end to end abutment to hold the other, major parts of the cores spaced a required distance from each other in the Y direction and thus to provide the beam path 20 between the deflectors 21 and 22. Of course, each pair of legs are spaced from each other in the X direction so as not to interfere with the travel of the electron beam along the path.

The cores 23 and 26 have each formed therein a groove 29 or 30 extending longitudinally thereof or in the Z direction. Each shaped as depicted in FIGS. 5 and 6, the grounded conductors 25 and 28 are snugly engaged one in each of these grooves 29 and 30 and have opposite end portions projecting from both ends of the grooves.

As will be noted by referring back to FIG. 1, the grounded conductors 25 and 28 are fastened by clamps 31 and 32 to the opposite ends of the cores 23 and 26. Extending beyond these clamps 31 and 32, the opposite end portions 25*a*, 25*b*, 28*a* and 28*b* of the grounded conductors 25 and 28 are bent right angularly and anchored to the pair of support beams 14 and 15, FIG. 7, in order to support the deflectors 21 and 22 in place within the envelope 2. Thus the grounded conductors 25 and 28 should be rigid and strong enough to carry the cores 23 and 26 and helical conductors 24 and 27.

Each in the form of a strip of sheet metal, the helical conductors 24 and 27 are coiled helically around the cores 23 and 26, respectively, as best pictured in FIG. 3. The grounded conductors 25 and 28 are also surrounded by the helical conductors 24 and 27 and positioned closer to, but spaced from, those portions of the helical conductors 24 and 27 which are opposite to their confronting portions.

The pair of deflectors 21 and 22 of the vertical deflection system 10 are shown parallel to each other in FIG. 1, with a constant spacing in the traveling direction of the beam. Because of the prepositioned quadrupolar lenses, the electron beam will enter the vertical deflection system 10 sufficiently compressed in the Y direction to reach the screen 4 without being obstructed by the deflectors 21 and 22 even if it is thereby deflected in that direction. As required, however, the pair of deflectors 21 and 22 may spread apart from its gun side end toward its screen side end, or may start spreading part in the middle of their longitudinal dimension.

FIG. 4 reveals series of shallow depressions 31 cut in both side surfaces of the cores 23 and 26 for receiving and positioning the sheet metal strips as they are coiled around the cores to form the helical conductors 24 and 27 Typically, the sheet metal strips of which the helical conductors are made are each 1.60 millimeters wide. They are coiled with a constant pitch of 2.38 millimeters. Cross sectionally, each coil thus formed is five millimeters wide and four millimeters high. The spacing between the two helical conductors 24 and 27, that is, the spacing between their surface portions bounding the beam path 20, is 0.9 millimeter.

With reference again to FIG. 7 the helical conductors 24 and 27 have their input ends electrically connected to input conductors 32*a* and 32*b* and thence to pins 33*a* and 33*b*, respectively, and their output ends electrically connected to output conductors 34*a* and 34*b* and thence to pins 35*a* and 35*b*, respectively. All the pins 33*a*, 33*b* , 35*a* and 35*b* project outwardly of the envelope 2.

Characteristic impedance and phase velocity are among the parameters that characterize the traveling wave deflection system according to this invention. Characteristic impedance depends mainly on the drive circuit. The wider the frequency band of the CRT incorporating the traveling wave deflectors, the less is the characteristic impedance. For example, the characteristic impedance of the traveling wave conductors is approximately 150 ohms in 1500 MHz CRTs, and approximately 100 ohms in wider band CRTs.

Being dependent upon the speed of the electron beam, the phase velocity of the traveling wave deflectors is a parameter determined actually by the accelerating voltage of the CRT. Thus the electron speed will be $$v=5.931\times10^5 V^{1/2} m/s$$

if the accelerating voltage V is 2.5 kilovolts. This electron speed determines in turn the phase velocity. The characteristics of the traveling wave deflectors are difficult to define because of their complex configurations. However, their fundamental characteristics may be expressed as follows from their simplified model given in FIG. 8, with the specific dielectric constant assumed to be one:

$$\frac{\partial V_n}{\partial s} = -L\frac{\partial i_n}{\partial t} - M\left(\frac{\partial i_{n+1}}{\partial t} + \frac{\partial i_{n-1}}{\partial t}\right) \tag{2}$$

$$\frac{\partial i_n}{\partial s} = -C\frac{\partial i_n}{\partial t} - C_0\frac{\partial}{\partial t}(V_{n+1} - V_n) + C_0\frac{\partial}{\partial t}(V_{n-1} - V_n) \tag{3}$$

By reason of their helical configuration the traveling wave conductors may be considered periodic. According to Floquet theorem, in an intrinsic mode of transmission in such periodic conductors, an electromagnetic field at a certain point at a certain frequency is equal to the multiplication by a complex constant of an electromagnetic field at another point one period away:

$$V_n = V_o \exp -j\beta(s+ml)\exp j\omega t \tag{4}$$

where l=length of each turn of the helical conductors 24 and 27, m=constant, and $V_o$=initial voltage value.

From Equation (4) the dispersion characteristic of the traveling wave deflectors can be defined as $$\beta^2/\omega^2 = (L\cdot C + 2L\cdot Co - 2M\cdot Co) + 2(-LCo + MC + 2MCo)\cos\beta 1 - 2MCo\cos\beta 1. \tag{5}$$

Equation (5) may be approximately restated as $$\beta/\omega \neq [\{(L+2M)\cdot C\}-\{(L+2M)Co-MC\}(\beta 1)^2]^{1/2}. \quad (6)$$

where ≠ stands for approximation.

It can be seen from Equation (6) that the dispersion term is proportional to {(L+2M) Co−MC}. There will be no dispersion if this term is negligible. The phase velocity u will be constant regardless of frequencies, being definable from Equation (6) as $$u32\ \omega/\beta=1/\{(L+2M)\cdot C\}^{1/2}.$$

In short, favorable traveling wave deflectors, free from dispersion, will be realized if the dispersion term {(L+2M) Co−MC} is reduced to a minimum. In practice, however, this requirement is very difficult to meet. As will be understood from the approximation model of FIG. 8, the parameters L, M, C and Co are not individually controllable. For example, Co would increase if the helical conductors 24 and 27 were made wider and the spacings between the conductor turns made narrower. But then C would also increase. Moreover, it is uncertain whether the dispersion term would decrease or not, and the characteristic impedance would lessen. It might also be contemplated to lessen both the pitch of, and the spacings between, the conductor turns, with the width of each conductor left unchanged. Co would then increase, but so would increase L and M, resulting in a lower phase velocity. Redesigning would be necessary in either case. Consequently, it is very difficult and unpractical to improve the dispersion characteristic with the characteristic impedance and phase velocity unchanged.

From the foregoing considerations the present invention proposes the optimization of the dispersion characteristic of the traveling wave conductors through control of the specific dielectric constant of the insulating cores 23 and 26. As has been mentioned with reference to FIG. 4, the helical conductors 24 and 27 are in parts received in the positioning depressions 31 in the opposite side surfaces of the insulating cores 23 and 26.

Figure 9:
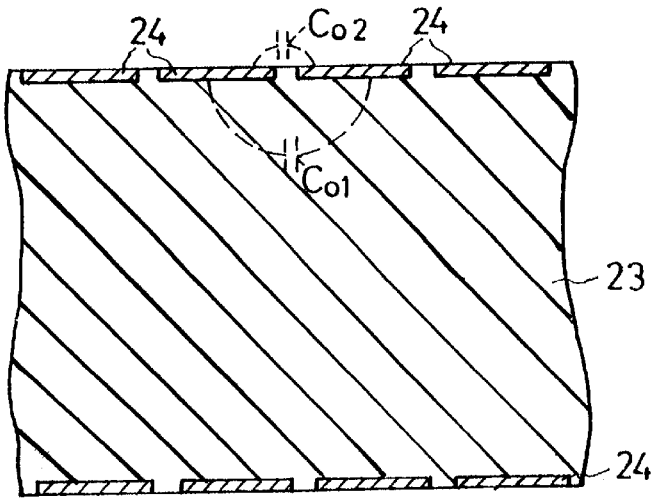
FIG. 9 is a fragmentary section through one of the deflectors of the FIG. 1 deflection system, taken along the line B—B in FIG. 2.

Therefore, as is apparent from FIG. 9, a section taken along the line B—B in FIG. 2, the capacitance Co between every two neighboring turns of each helical conductor 24 or 27 resolves itself into a component $Co_1$ through the insulating core 23 or 26 and a component $Co_2$ through the evacuated space within the CRT envelope, vacuum being different in specific dielectric constant from the insulating core. The component capacitance $Co_1$ is proportional to the specific dielectric constant of the core 23 or 26, so that not only this component capacitance but also the total interturn capacitance Co is controllable through adjustment of the specific dielectric constant of the cores 23 or 26 for the optimum dispersion characteristic.

It must be taken into account, however, that a change in the specific dielectric constant of the cores 23 and 26 results in a change in the capacitance C between helical conductors 24 and 27 and grounded conductors 25 and 28 and hence in the characteristic impedance of the traveling wave conductors. For this reason the optimization of the dispersion characteristic requires the control of the interturn capacitance Co, that is, that of the specific dielectric constant of the cores 23 and 26, in relation to the characteristic impedance of the traveling wave deflectors.

Experiments were conducted to ascertain relations between the specific dielectric constant of the insulating cores 23 and 26 and the characteristic impedance of the traveling wave deflectors for optimum dispersion characteristics. The results were as follows:

| Characteristic Impedance Zo (ohm) | Specific Dielectric Constant |
|---|---|
| 80 ≦ Zo ≦ 120 | 9–14 |
| 120 < Zo ≦ 140 | 5–10 |
| 140 < Zo ≦ 160 | 4–6 |

In the traveling wave deflection system used in the experiments above, the accelerating voltage was 2.5 kilovolts; the gap between the deflectors 21 and 22 was 0.9 millimeter; each of the deflectors 21 and 22 was five millimeters wide and four millimeters high; and the helical conductors 24 and 27 were 2.38 millimeters in pitch and 1.6 millimeters in width.

Among the materials used for fabricating the insulating cores 23 and 26 were boron nitride with a specific dielectric constant of 3.0, Machinax (trademark for a ceramic manufactured by Mitsui Kozan Material K.K.) with a specific dielectric constant of 4.7, Macerite (trademark for a ceramic manufactured by Mitsui Kozan Material K.K.) with a specific dielectric constant of 6.0, Shapal M (trademark for a ceramic manufactured by Tokuyama Soda K.K.) with a specific dielectric constant of 7.1, alumina with a specific dielectric constant of 9.0, and Lotec TM (trademark for a ceramic manufactured by Ishihara Yakuhin K.K.) with a specific dielectric constant of 12.0.

Second Form

Figure 11:
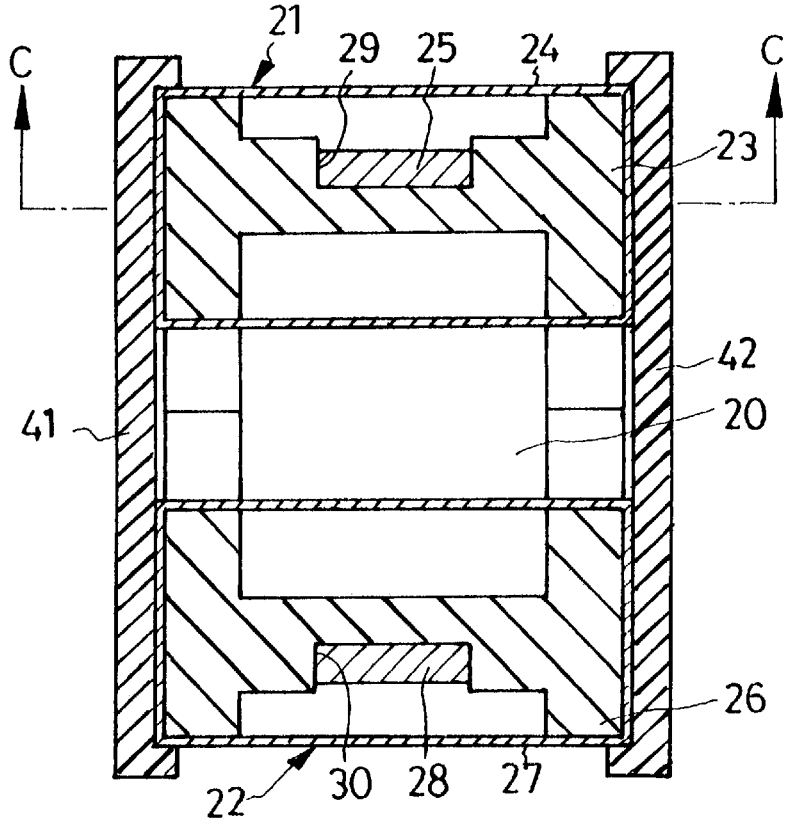
FIG. 11 is a view similar to FIG. 2 but showing another preferred form of deflection system according to the invention, the alternate deflection system being also intended for use in the FIG. 7 CRT for vertical beam deflection.
Figure 12:
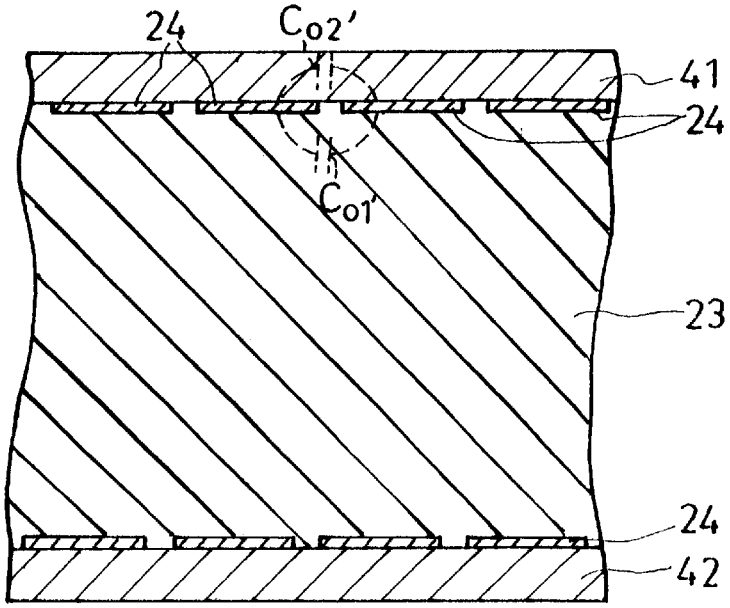
FIG. 12 is a fragmentary section through one of the deflectors of the alternate deflection system, taken along the line C—C in FIG. 11.

In another preferred form of vertical deflection system shown in FIGS. 11 and 12, also for use in the FIG. 7 CRT in substitution for the first disclosed vertical deflection system 10, the pair of deflectors 21 and 22 have their opposite side surfaces covered by a pair of flat covers 41 and 42 of electrically insulating material. The covers 41 and 42 on the deflectors 21 and 22 are extended toward, and joined to, each other thereby closing the opposite sides of the passageway 20 of the electron beam. This alternate deflection system is akin to the foregoing system 10 in the other details of construction.

The primary function of the insulating covers 41 and 42 is to cover the outer surfaces of those parts of the helical conductors 24 and 27 which are received in the positioning depressions 31, FIG. 4, in the side surfaces of the insulating cores 23 and 26. These outer surfaces are left exposed to the evacuated interior of the envelope 2 in the foregoing embodiment.

Thus, as indicated in FIG. 12, the capacitance Co between the adjacent turns of each helical conductor 24 or 27 is the sum of the component $Co_1'$ through the insulating core 23 or 26 and the component $Co_2'$ through the insulating cover 41 or 42. The specific dielectric constant of the covers 41 and 42 is variable through choice of the material therefor. The interturn capacitance Co for an optimum dispersion characteristic for a wide band deflection system is therefore obtainable through adjustment of not only the specific dielectric constant of the insulating cores 23 and 26 but also that of the insulating covers 41 and 42. A greater latitude is thus offered in designing the traveling wave deflection system according to the present invention.

Possible Modifications

Notwithstanding the foregoing detailed description, it is not desired that the present invention be limited by the exact showing of the drawings or the description thereof. The following is a brief list of possible modifications or alterations of the illustrated embodiments which are all believed to fall within the scope of this invention:

1. The positioning indentations 31 in the insulating cores 29 and 20 may be varied in depth in order to control the degree to which the cores affect the interturn capacitance Co.

2. The insulating covers 41 and 42 could cover all but those surface of the deflectors 21 and 22 which confront each other to define the beam path 20.

3. The insulating covers 41 and 42 could be formed only on the top surface, as seen in FIG. 11, of the upper deflector 21 and on the bottom surface, also as seen in FIG. 11, of the lower deflector 22.

What is claimed is:

1. A traveling wave deflection system having a pair of deflectors disposed opposite each other across a path of an electron beam, each deflector comprising:

(a) a core of electrically insulating material extending along the electron beam path;

(b) a helical conductor coiled around the core; and (c) a grounded conductor mounted to the core and disposed inside the helical conductor and extending along the electron beam path;

the core having a specific dielectric constant determined for an optimum dispersion characteristic of the deflector and wherein the helical conductor of each deflector is partly received in positioning depressions formed in the core, whereby capacitances between adjacent turns of the helical conductor are controllable by the specific dielectric constant of the core.

2. The traveling wave deflection system of claim 1 wherein each deflector further comprises a cover of electrically insulating material covering at least part of the deflector except a surface thereof which is opposed to the other deflector, whereby capacitances between adjacent turns of the helical conductor are controllable not only by the specific dielectric constant of the core but also by that of the cover.

* * * * *

UNITED STATES PATENT AND TRADEMARK OFFICE

CERTIFICATE OF CORRECTION

PATENT NO. : 6,184,615 B1
DATED : February 6, 2001
INVENTOR(S) : Tsutomu Tobari

It is certified that error appears in the above-identified patent and that said Letters Patent is hereby corrected as shown below:

Column 6,
Line 48, please insert the following:

-- where
n=nth turn of the helical conductors 24 and 27,
s=length of the helical conductors 24 and 27,
L=inductance per unit length of the helical conductors 24 and 27,
C=capacitance between unit lengths of the helical conductors 24 and 27 and the grounded conductors 25 and 28,
Co=capacitance between unit lengths of the adjacent turns of the helical conductors 24 and 27,
*M* = mutual inductance between unit lengths of the adjacent turns of the helical conductors 24 and 27,
$V_n$,$V_{n-1}$, and $V_{n=1}$=voltages of the nth, (n-1)th, and (n+1)th turns of the helical conductors 24 and 27,
$i_n$, $i_{n-1}$, and $i_{n=1}$=currents of the nth, (n-1)th, and (n+1)th turns of the helical conductors 24 and 27, and
t=time --;

Column 7,
Line 11, please delete "u32ω/β=1/{(L+2M)·C}$^{1/2.}$" and insert therefor
-- u=ω/β=1/{(L+2M)·C}$^{1/2.}$ --;

Signed and Sealed this

Twentieth Day of August, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,184,615 B1
DATED : February 6, 2001
INVENTOR(S) : Tsutomu Tobari

It is certified that error appears in the above-identified patent and that said Letters Patent is hereby corrected as shown below:

Column 6,
Line 48, please insert the following:

-- where
n=nth turn of the helical conductors 24 and 27,
s=length of the helical conductors 24 and 27,
L=inductance per unit length of the helical conductors 24 and 27,
C=capacitance between unit lengths of the helical conductors 24 and 27 and the grounded conductors 25 and 28,
Co=capacitance between unit lengths of the adjacent turns of the helical conductors 24 and 27,
*M* = mutual inductance between unit lengths of the adjacent turns of the helical conductors 24 and 27,
$V_n$,$V_{n-1}$, and $V_{n+1}$=voltages of the nth, (n-1)th, and (n+1)th turns of the helical conductors 24 and 27,
$i_n$, $i_{n-1}$, and $i_{n=1}$=currents of the nth, (n-1)th, and (n+1)th turns of the helical conductors 24 and 27, and
t=time --;

Column 7,
Line 11, please delete "u32ω/β=1/{(L+2M)·C}$^{1/2.}$" and insert therefor
-- u=ω/β=1/{(L+2M)·C}$^{1/2.}$ --;

This certificate supersedes Certificate of Correction issued August 20. 2002.

Signed and Sealed this

Twenty-third Day of March, 2004

JON W. DUDAS
*Acting Director of the United States Patent and Trademark Office*